US007959351B1

(12) United States Patent
Thorpe

(10) Patent No.: US 7,959,351 B1
(45) Date of Patent: Jun. 14, 2011

(54) HAND WORN WATCH APPARATUS

(76) Inventor: Derek B. Thorpe, Jacksonville, FL (US)

( * ) Notice: Subject to any disclaimer, the term of this patent is extended or adjusted under 35 U.S.C. 154(b) by 0 days.

(21) Appl. No.: 12/611,526

(22) Filed: Nov. 3, 2009

(51) Int. Cl.
*G04B 37/12* (2006.01)
*A44C 5/00* (2006.01)

(52) U.S. Cl. ..... 368/282; 368/279; 224/164; 224/217

(58) Field of Classification Search ..... 224/164–180, 224/217; 368/276, 279, 281–283; 2/160
See application file for complete search history.

(56) References Cited

U.S. PATENT DOCUMENTS

| | | | | | |
|---|---|---|---|---|---|
| 124,464 | A | * | 3/1872 | Waters | 56/331 |
| 601,982 | A | * | 4/1898 | Peirson | 224/170 |
| 907,012 | A | * | 12/1908 | Day | 224/217 |
| 1,416,654 | A | * | 5/1922 | Lenneberg | 224/217 |
| 1,628,278 | A | * | 5/1927 | Scheuer | 63/3.1 |
| 1,640,004 | A | * | 8/1927 | Lundblad | 224/217 |
| 1,719,641 | A | * | 7/1929 | Abrahamson | 224/217 |
| 2,103,711 | A | * | 12/1937 | Cole | 2/160 |
| 2,377,623 | A | * | 6/1945 | French | 224/217 |
| 2,926,825 | A | * | 3/1960 | Wing | 224/164 |
| 4,281,389 | A | * | 7/1981 | Smith | 702/178 |
| 4,681,462 | A | | 7/1987 | Lloyd | |
| D300,910 | S | * | 5/1989 | Buford | D11/2 |
| 4,862,521 | A | | 9/1989 | Mann | |
| 5,124,960 | A | * | 6/1992 | Miller et al. | 368/278 |
| 5,659,611 | A | * | 8/1997 | Saksa | 379/433.1 |
| 5,749,841 | A | * | 5/1998 | Moore | 602/21 |
| 5,779,113 | A | | 7/1998 | Huang | |
| 5,871,406 | A | * | 2/1999 | Worrell | 473/221 |
| 5,924,136 | A | * | 7/1999 | Ogean | 2/159 |
| 6,154,199 | A | * | 11/2000 | Butler | 345/167 |
| D438,483 | S | * | 3/2001 | Mesica | D11/3 |
| 6,392,962 | B1 | * | 5/2002 | Wyatt | 368/107 |
| 6,411,570 | B1 | * | 6/2002 | Smith | 368/73 |
| 6,519,207 | B1 | * | 2/2003 | Lukacsko | 368/10 |
| 6,603,711 | B2 | * | 8/2003 | Calace | 368/109 |
| 7,334,711 | B1 | * | 2/2008 | Winters | 224/217 |
| 2003/0057240 | A1 | * | 3/2003 | Johnson | 224/219 |
| 2004/0190383 | A1 | * | 9/2004 | Marcucelli et al. | 368/278 |
| 2006/0126446 | A1 | * | 6/2006 | Martens et al. | 368/282 |
| 2007/0159930 | A1 | * | 7/2007 | Montgomery | 368/281 |
| 2008/0248838 | A1 | * | 10/2008 | Chiang | 455/566 |
| 2010/0177604 | A1 | * | 7/2010 | Ginter | 368/282 |

* cited by examiner

*Primary Examiner* — Sean Kayes
(74) *Attorney, Agent, or Firm* — Crossley Patent Law; Mark A. Crossley

(57) ABSTRACT

The hand worn watch apparatus provides a wrist band, an index band, and a thumb band for securing the pliable material to the delta area of a wearer's hand. Not only is the delta area a more comfortable and logical location, the area is larger than a typical wrist, whereby the apparatus can feature far more functions and electronics than a typical wristwatch. Further, a wearer does not have to practice elbow abduction and forearm pronation to read the display, use the controls or tell time. The apparatus is especially useful for those in sports as well as those driving a car. A user need not pronate the hand when engaged in sports and driving. And, a wearer's gold swing is not hindered by the apparatus. The apparatus is further designed to be noticed in making a fashion statement.

2 Claims, 4 Drawing Sheets

HAND WORN WATCH APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

There exist three distinct movements of the upper extremity necessary in telling time on a traditional wristwatch, from a standing position: the abduction of the elbow away from the body, the flexing of the elbow, and pronation of the forearm. The present apparatus negates two of these movements by placing the apparatus functional features in what is known as the delta shaped area between the wrist, the base of the thumb and index finger. Therefore, the abduction of the elbow and the pronation of the forearm are eliminated. In addition to relocating the watch display to this area of the hand and wrist, the apparatus further provides multiple electronic function and controls in this easy to see and use position. By locating controls and functions in this area larger than the wrist, more features are available to the wearer.

FIELD OF THE INVENTION

The hand worn watch apparatus relates to watches and personal electronic devices and more especially to a watch having multiple other functions all positioned in the hand delta region and secured by thumb band, index band, and wrist band.

SUMMARY OF THE INVENTION

The general purpose of the hand worn watch apparatus, described subsequently in greater detail, is to provide a hand worn watch apparatus which has many novel features that result in an improved hand worn watch apparatus which is not anticipated, rendered obvious, suggested, or even implied by prior art, either alone or in combination thereof.

To attain this, the hand worn watch apparatus provides a wrist band, an index band, and a thumb band for securing the pliable material to the delta area of a wearer's hand. Not only is the delta area a more comfortable and logical location, the area is larger than a typical wrist location, whereby the apparatus can feature far more functions and electronics than a typical wristwatch. Further, a wearer does not have to practice elbow abduction and forearm pronation to read the display, use the controls or tell time. The apparatus is especially useful for those in sports as well as those driving a car.

With the hand in the 10 o-clock position on a steering wheel, no hand or wrist movements need occur. A user need not pronate the hand when engaged in sports and needing access to the controls and display. A further advantage of the positioning of the panel is that a wearer is less likely to strike the watch face, as compared to a typical wristwatch. And, too, a wearer's gold swing is not hindered by the apparatus.

The apparatus is further designed to be noticed in making a fashion statement. As the panel is removable from the pliable material, battery compartment access is easy. While the illustrated bands are offered with clasps, the apparatus is also made with elastic bands for claspless hold to a user's hand and wrist.

Thus has been broadly outlined the more important features of the improved hand worn watch apparatus so that the detailed description thereof that follows may be better understood and in order that the present contribution to the art may be better appreciated.

An object of the hand worn watch apparatus is to provide more convenience than a typical wristwatch.

Another object of the hand worn watch apparatus is to provide multiple electronic functions not typically available in a smaller wristwatch.

A further object of the hand worn watch apparatus is to be stylish.

An added object of the hand worn watch apparatus is to provide for less personal movement when reading the display and operating the various electronic functions.

And, an object of the hand worn watch apparatus is to provide a removable panel holding the electronic functions and features.

These together with additional objects, features and advantages of the improved hand worn watch apparatus will be readily apparent to those of ordinary skill in the art upon reading the following detailed description of presently preferred, but nonetheless illustrative, embodiments of the improved hand worn watch apparatus when taken in conjunction with the accompanying drawings.

In this respect, before explaining the current embodiments of the improved hand worn watch apparatus in detail, it is to be understood that the hand worn watch apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved hand worn watch apparatus. It is therefore important that the claims be regarded as including such equivalent constructions insofar as they do not depart from the spirit and scope of the hand worn watch apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the hand worn watch apparatus generally designated by the reference number 10 will be described.

Figure 1:
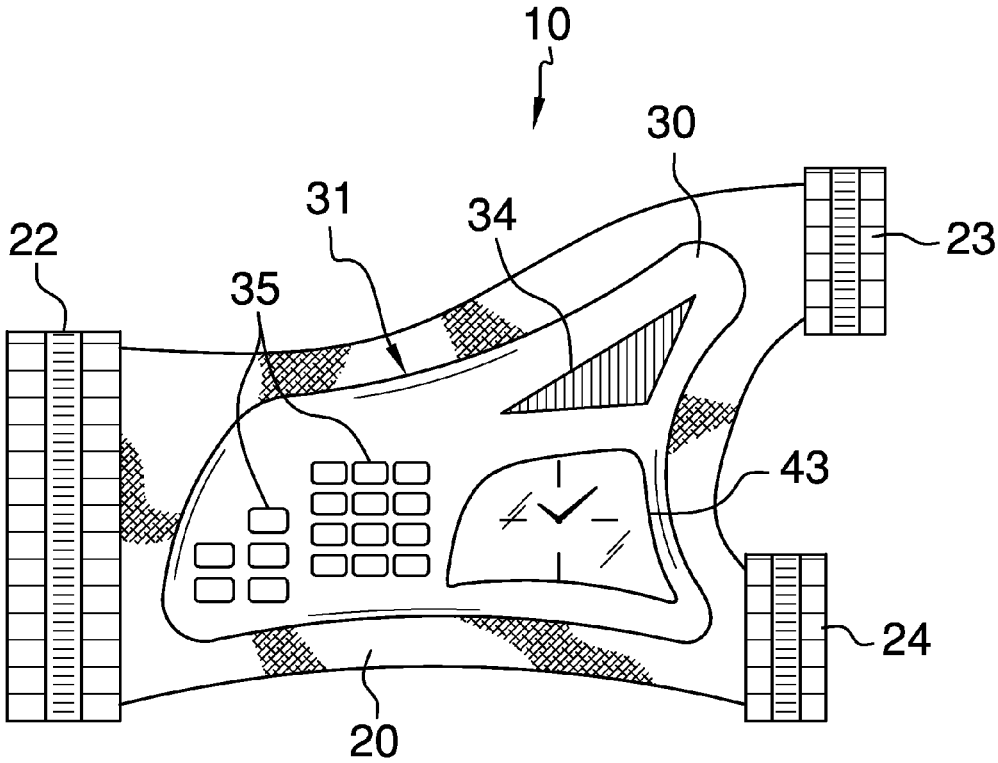
FIG. 1 is a top plan view.
Figure 3:
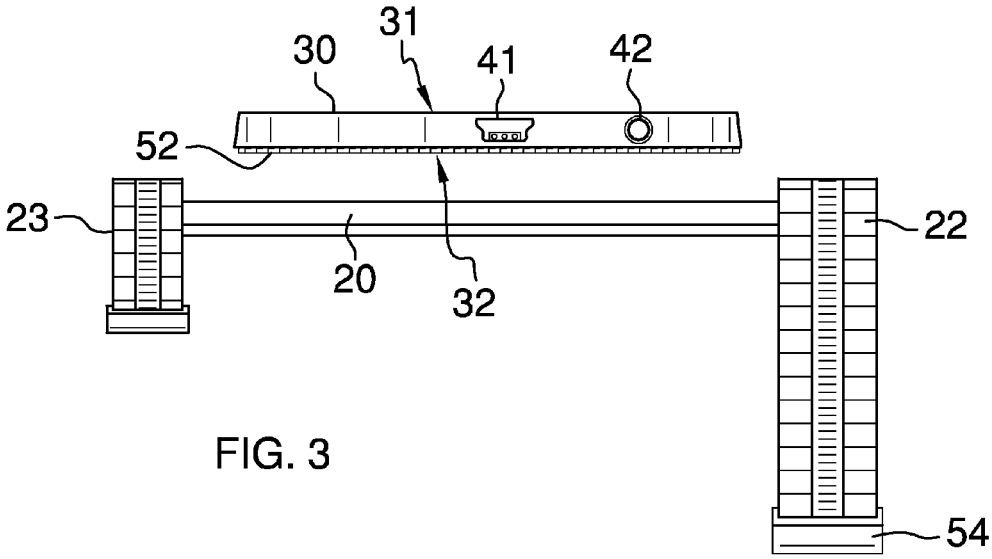
FIG. 3 is lateral elevation view with panel removed.

Referring to FIGS. 1 and 3, the apparatus 10 partially comprises the index band 23 with clasp 54, the thumb band 24 with clasp 54 and the wrist band 22 with clasp 54. The wrist band 22 is worn around a wearer's wrist 13. The index band 23 is worn around a wearer's index finger 14. The thumb band 24 is worn around a wearer's thumb 15. The pliable material 20 connects the bands. The pliable material 20 is worn on a delta area of a wearer's hand 12.

Figure 2:
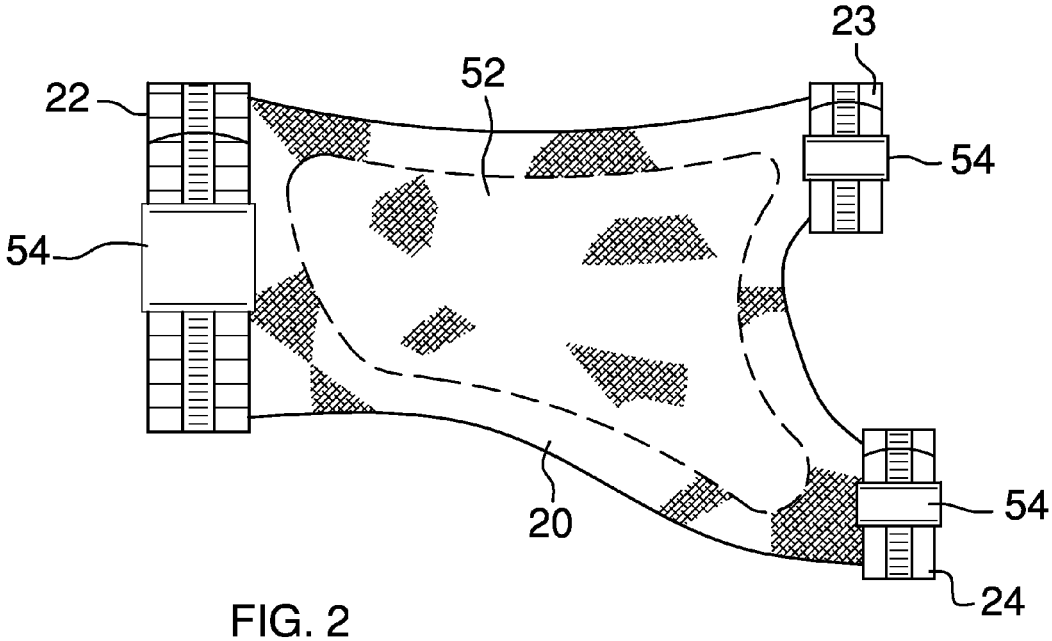
FIG. 2 is a top plan view with panel removed.
Figure 2A:
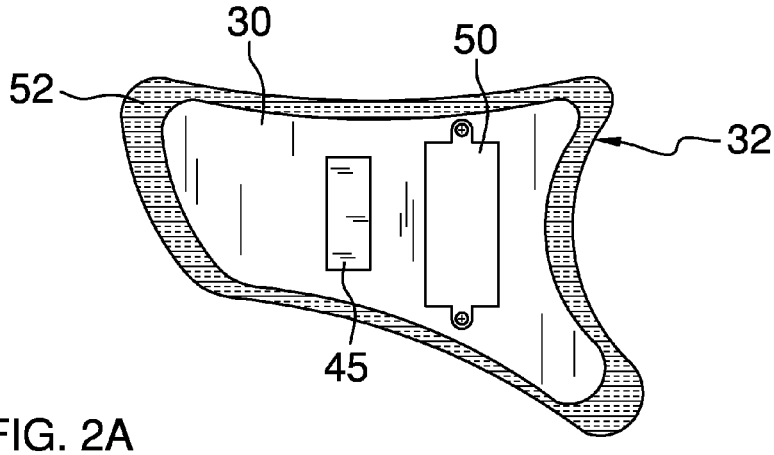
FIG. 2A is a bottom plan view of the panel.

Referring to FIGS. 2, 2A, and 3, Velcro™ 52 is disposed on the pliable material 20. The panel 30 is provided and has a top 31 and a bottom 32. Velcro™ 52 is disposed on the panel 30 bottom 32. The Velcro™ 52 removably affixes to the pliable material 20 Velcro™ 52. The battery compartment 50 is disposed on the panel 30 bottom 32.

Figure 6:
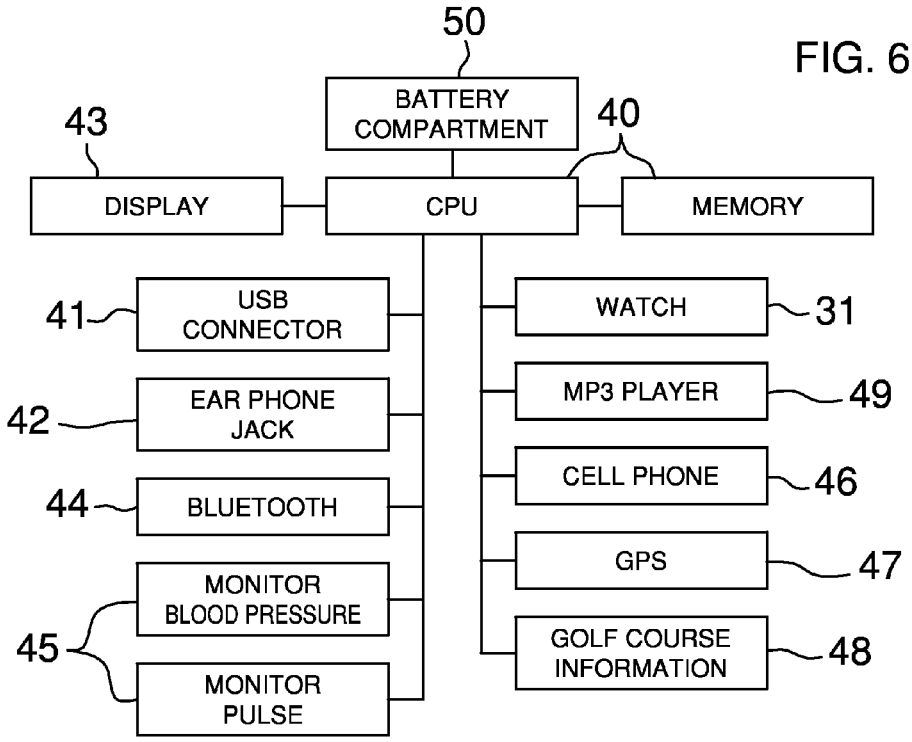
FIG. 6 is a schematic block diagram of electronics of the apparatus.

Referring to FIGS. 2A and 6, the physical monitor 45 is disposed on the panel 30 bottom 32 and provides the dual functions of monitor of blood pressure and pulse monitor.

Figure 4:
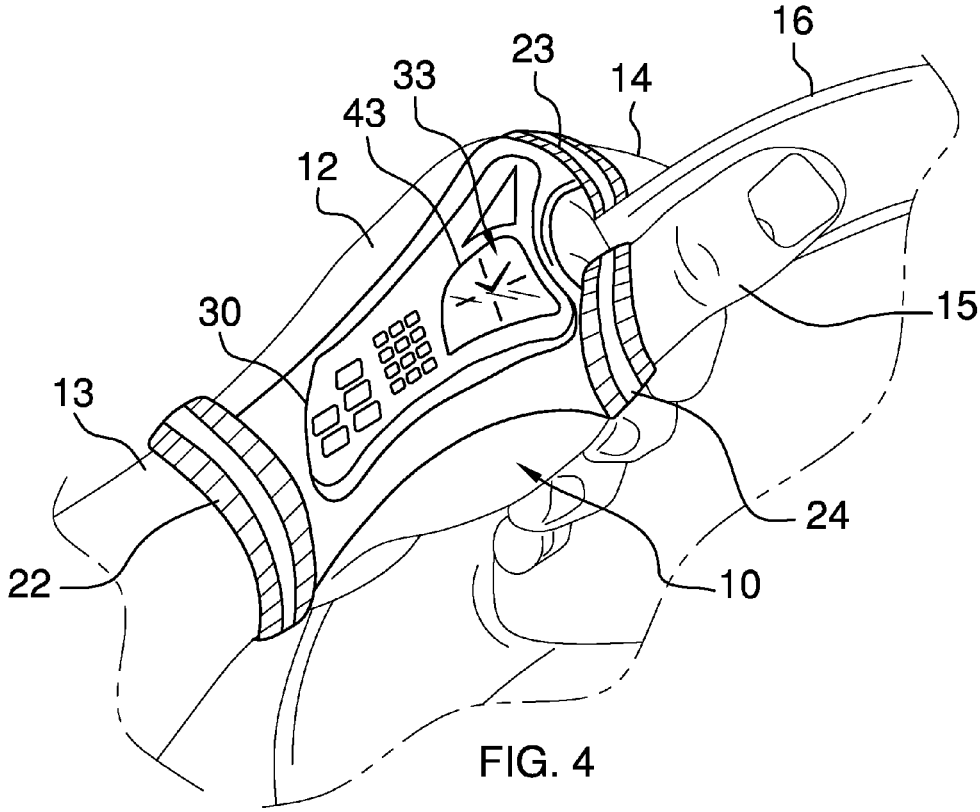
FIG. 4 is a perspective view fitted to a wearer.

Referring again to FIG. 1 and also to FIG. 4, the display 43 is disposed within the panel 30 top 31. The watch 33 is disposed within the display 43. The speaker 34 is disposed proximal to the display 43. The controls 35 are disposed within the panel 30 top 31.

Referring to FIG. 3, the USB connector 41 is disposed within the panel 30. The earphone jack 42 is disposed within the panel 30.

Referring again to FIG. 6, a Bluetooth® 44 is disposed within the panel 30. An MP3 player 49 is disposed within the panel 30. A cell phone 46 is disposed within the panel 30. A GPS 47 is disposed within the panel 30. A golf course information 48 is disposed within the panel 30 and allows a user to acquire course information from those courses that provide such. The CPU with memory 40 is disposed within the panel 30. The CPU with memory 40 is in communication with the battery compartment 50, the physical monitor 45, the display 43, the watch 33, the speaker 34, the controls 35, the USB connector 41, the earphone jack 42, the Bluetooth® 44, the MP3 player 49, the cell phone 46, the GPS 47, and the golf course information 48. The display 43 and controls 35 are naturally positioned for best access on the steering wheel 16.

Figure 5:
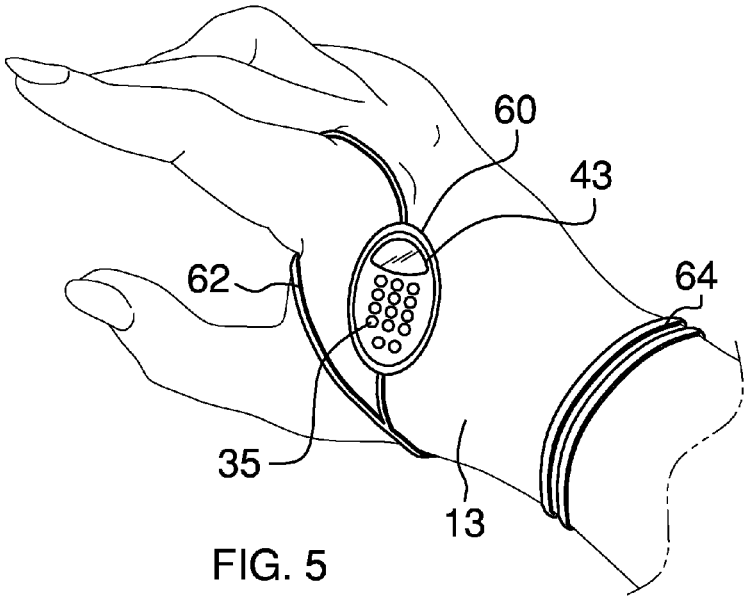
FIG. 5 is an alternate embodiment fitted to a wearer.

Referring to FIG. 5 and also to FIG. 6, the alternate embodiment of the apparatus 10 partially comprises the double wrist band 64. The index loop 62 is connected to the double wrist band 64.

The oval panel 60 is connected to the index loop 62. The oval panel 60 is positioned on a delta area of a wearer's hand 12. The oval panel 60 further comprises the display 43, the controls 35, a battery compartment (not shown), and a CPU 40 with memory in communication with the display 43, the controls 35, and the battery compartment.

With respect to the above description then, it is to be realized that the optimum dimensional relationships for the parts of the hand worn watch apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the hand worn watch apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the hand worn watch apparatus may be used.

Therefore, the foregoing is considered as illustrative only of the principles of the hand worn watch apparatus. Further, since numerous modifications and changes will readily occur to those skilled in the art, it is not desired to limit the hand worn watch apparatus to the exact construction and operation shown and described, and accordingly, all suitable modifications and equivalents may be resorted to, falling within the scope of the hand worn watch apparatus.

What is claimed is:

1. A hand worn watch apparatus comprising, in combination:

an index band with clasp;
a thumb band with clasp;
a wrist band with clasp;
a pliable material connecting the bands, the pliable material worn on a delta area of a wearer's hand;
a hook and loops fastener disposed on the pliable material;
a panel having a top and a bottom;
a hook and loops fastener disposed on the panel bottom, the panel bottom hook and loops fastener removably affixed to the pliable material hook and loops fastener;
a battery compartment disposed on the panel bottom;
a display disposed within the panel top;
a watch disposed within the display;
a speaker disposed proximal to the display;
a controls disposed within the panel top;
a USB connector disposed within the panel;
an earphone jack disposed within the panel;
a bluetooth disposed within the panel;
a MP3 player disposed within the panel;
a cell phone disposed within the panel;
a GPS disposed within the panel;
a golf course information disposed within the panel;
a CPU with memory disposed within the pane, the CPU with memory in communication with the battery compartment, the display, the watch, the speaker, the controls, the USB connector, the earphone jack, the bluetooth, the MP3 player, the cell phone, the GPS, and the golf course information.

2. A hand worn watch apparatus comprising, in combination:

an index band with clasp;
a thumb band with clasp;
a wrist band with clasp;
a pliable material connecting the bands, the pliable material worn on a delta area of a wearer's hand;
a hook and loops fastener disposed on the pliable material;
a panel having a top and a bottom;
a hook and loops fastener disposed on the panel bottom, the panel bottom hook and loops fastener removably affixed to the pliable material hook and loops fastener;
a battery compartment disposed on the panel bottom;
a physical monitor disposed on the panel bottom;
a display disposed within the panel top;
a watch disposed within the display;
a speaker disposed proximal to the display;
a controls disposed within the panel top;
a USB connector disposed within the panel;
an earphone jack disposed within the panel;
a bluetooth disposed within the panel;
a MP3 player disposed within the panel;
a cell phone disposed within the panel;
a GPS disposed within the panel;
a golf course information disposed within the panel;
a CPU with memory disposed within the pane, the CPU with memory in communication with the battery compartment, the physical monitor, the display, the watch, the speaker, the controls, the USB connector, the earphone jack, the bluetooth, the MP3 player, the cell phone, the GPS, and the golf course information.

* * * * *